US007377489B1

(12) United States Patent
Houseman

(10) Patent No.: US 7,377,489 B1
(45) Date of Patent: May 27, 2008

(54) PICKET FENCE BUILDING GUIDE

(76) Inventor: Eric M. Houseman, 1503 Lark Bunting Pl., Longmont, CO (US) 80501

( * ) Notice: Subject to any disclaimer, the term of this patent is extended or adjusted under 35 U.S.C. 154(b) by 53 days.

(21) Appl. No.: 11/369,645

(22) Filed: Mar. 7, 2006

Related U.S. Application Data

(60) Provisional application No. 60/659,693, filed on Mar. 8, 2005.

(51) Int. Cl.
*B21F 27/00* (2006.01)
*E04H 17/16* (2006.01)

(52) U.S. Cl. ..... 256/22; 256/65.02; 403/292; 403/293; 33/645

(58) Field of Classification Search ..... 256/22, 256/1, 65.01, 65.02, 65.08, 65.15; 403/292, 403/293; 33/613, 645, 370–373
See application file for complete search history.

(56) References Cited

U.S. PATENT DOCUMENTS

| | | | | |
|---|---|---|---|---|
| 2,106,601 | A * | 1/1938 | Copeland et al. | 256/13.1 |
| 3,201,874 | A | 8/1965 | Christy | |
| 3,230,626 | A | 1/1966 | Berrien | |
| 4,420,921 | A | 12/1983 | Hardin | |
| 4,583,278 | A | 4/1986 | Flores et al. | |
| 4,625,415 | A * | 12/1986 | Diamontis | 33/613 |
| 5,163,233 | A | 11/1992 | Benson | |
| 5,491,905 | A | 2/1996 | Jablonski et al. | |
| 5,628,119 | A | 5/1997 | Bingham et al. | |
| 6,173,503 | B1 | 1/2001 | Houghton et al. | |
| 6,293,028 | B1 | 9/2001 | Sylvia | |
| 6,658,753 | B2 * | 12/2003 | Tatarnic | 33/613 |
| 6,758,627 | B2 * | 7/2004 | King | 404/6 |
| 6,913,249 | B1 * | 7/2005 | Lerdu | 256/24 |
| 6,932,329 | B1 * | 8/2005 | Harder | 256/67 |
| 6,993,882 | B2 * | 2/2006 | Crawford et al. | 52/696 |
| 2002/0095813 | A1 | 7/2002 | Tatarnic | |
| 2004/0211076 | A1 | 10/2004 | Vicario | |

* cited by examiner

*Primary Examiner*—Daniel P. Stodola
*Assistant Examiner*—Nahid Amiri
(74) *Attorney, Agent, or Firm*—Rick Martin; Patent Law Offices of Rick Martin, P.C.

(57) ABSTRACT

A guide for aligning pickets during the building of a picket fence. The guide having a picket stand to attach to a first end of an alignment beam. The guide having a beam stand to attach to a second end of the alignment beam. A method is also disclosed to construct the picket fence.

6 Claims, 11 Drawing Sheets

PICKET FENCE BUILDING GUIDE

CROSS REFERENCE APPLICATIONS

This application is a non-provisional application claiming the benefits of provisional application No. 60/659,693 filed Mar. 8, 2005.

FIELD OF INVENTION

The present invention relates to a method and guide apparatus to efficiently build a picket fence.

BACKGROUND OF THE INVENTION

Property owners who wish to have a picket fence on their property, are desirous that the tops of the pickets are aligned in perfectly straight lines, between selected points along the fence at least, in order to present a neat and pleasing appearance. In order to aid the fence builder to achieve that end, and at the same time to minimize the cost of achieving that end, it is desirable that the builder have some form of reliable guide and method.

One method is to secure a taut string between suitable points along the fence as the pickets are installed. This involves the careful mounting of supports for the string in a manner to position the string in the plane of the pickets, in a manner to position the string the correct distance above the top rail, and in a manner to assure that the string will remain taut. One disadvantage is that, on a windy day, the string may be off line and may stretch and sag. Another disadvantage is that great care must be exercised by the builder in positioning the pickets, so that the string is not displaced by any one picket. This system then is unreliable, is difficult to work with, and requires additional time for the correct placing of the pickets.

It would be desirable to have a method, including the use of a good fixture, wherein the fixture may be simply placed on the fence and be self-supporting, wherein the pickets may be abutted against the fixture without concern for displacing the alignment guide or line, and wherein the fixture may be readily adjusted, and adapted for different rises of the pickets above the top rail of the fence.

These basic needs are addressed by U.S. Pat. No. 4,583,278 (1986) to Flores et al. Flores discloses a one piece guide having a horizontally supported beam about eight feet long. At each end is a pair of support legs. Holes and adjustable support pins provide the user with a selectable height for the top of pickets. One end of the beam sits astride a first picket. The opposite end of the beam is supported by the top rail of the fence. Thus the beam forms a guide for leveling the rest of the picket tops.

Flores does not provide a means to level the fence posts or rails. He does not provide a convenient kit that is readily packaged and shipped. The present invention does provide these features, as well as a complete method to install a picket fence.

SUMMARY OF THE INVENTION

An aspect of the present invention is to provide a picket fence top guide kit with a pair of end pieces that can be attached to a chosen beam in the field.

Another aspect of the present invention is to provide a pair of levels on the end pieces.

Another aspect of the present invention is to provide an adjustable height assembly for the end pieces.

Another aspect of the present invention is to provide a complete method, using the kit, to install a picket fence.

Other aspects of this invention will appear from the following description and appended claims, reference being made to the accompanying drawings forming a part of this specification wherein like reference characters designate corresponding parts in the several views.

A pair of plastic end pieces are readily attachable to a beam of any length in the field. A typical beam would be a 2×4 by eight foot wooden beam used as a guide to level picket fence tops.

The end pieces have two levels which are used to level the fence posts and rails prior to attaching the pickets. The kit, along with a complete fence installation set of instructions, is readily packaged for ease of retail display and shipping.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
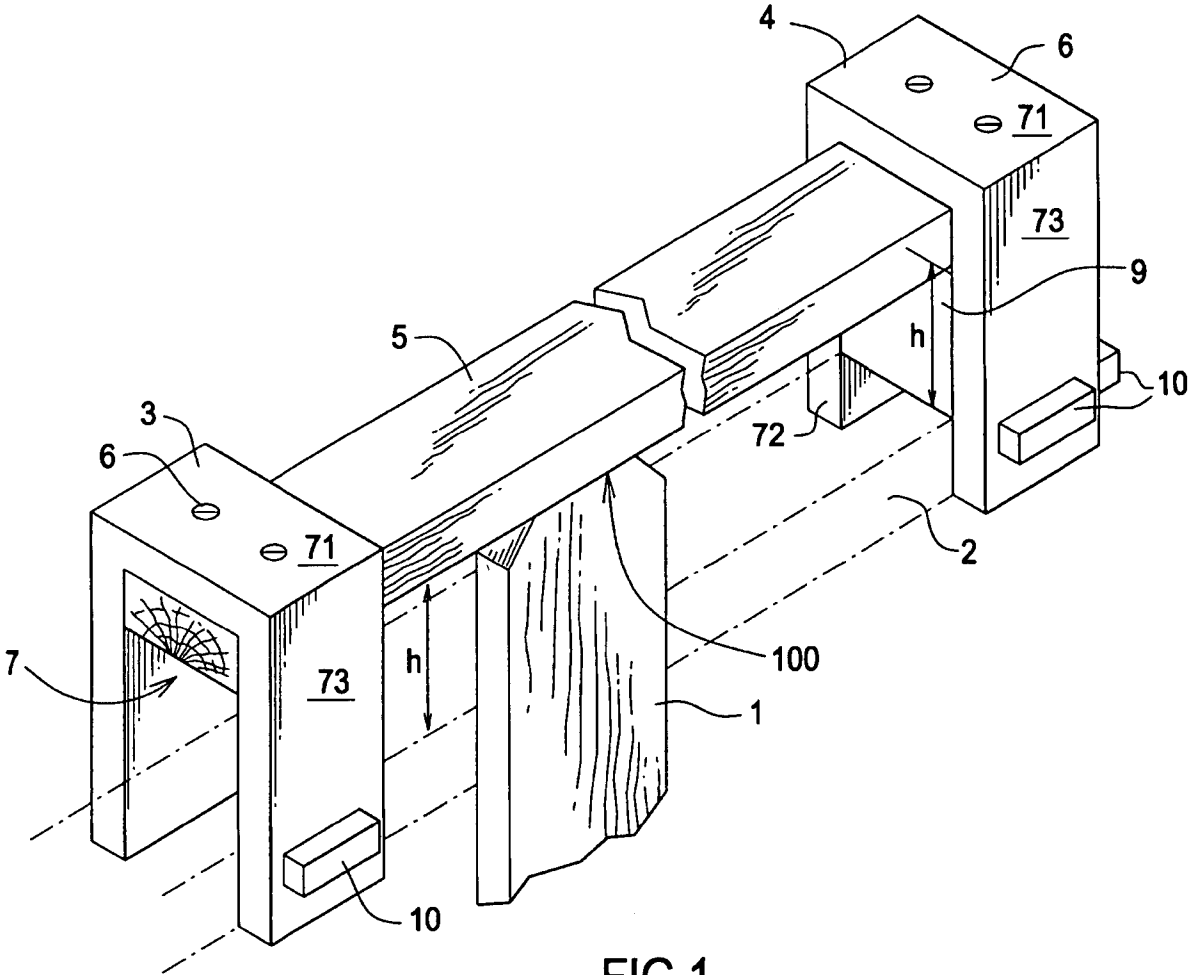
FIG. 1 is a top perspective view of a pair of support end pieces attached to a beam.

Referring first to FIG. 1 a fence guide assembly kit is designated 3, 4. A picket stand 3 is a three sided stand having top 71, and equal logs 72, 73. Opening 7 can straddle rail 2. Top 71 straddles the wide side of a standard 2×4, with screws 6 removably affixing the picket stand 3 to the beam 5. A bubble level 10 is used to properly construct the fence.

The beam 5 is cut to a chosen length (perhaps eight feet) to align a segment of pickets 1 at their tops 100. Opposite from picket stand 3 on the beam 5 is affixed via screws 6 a beam stand 4. In the opening 8 a block 9 is placed having a height h, which is equal to the height of the picket top 100 above the rail 2.

In operation the builder places his guide assembly 3, 4, 5 as shown on top of picket 1 top 100. The block 9 sets the same height h between the rail 2 and subsequent pickets. Various heights h can be chosen. Levels 10 are used to check the level of picket tops 100, as well as to straighten posts (not shown), as well as to level the rail 2. By removing block 9 the stands 3, 4 can be used to straddle the rail 2 and level it, before rail 2 is permanently affixed to the posts. A kit made up of members 3, 4, 9, 6 can be readily disassembled, boxed and shipped.

Figure 2:
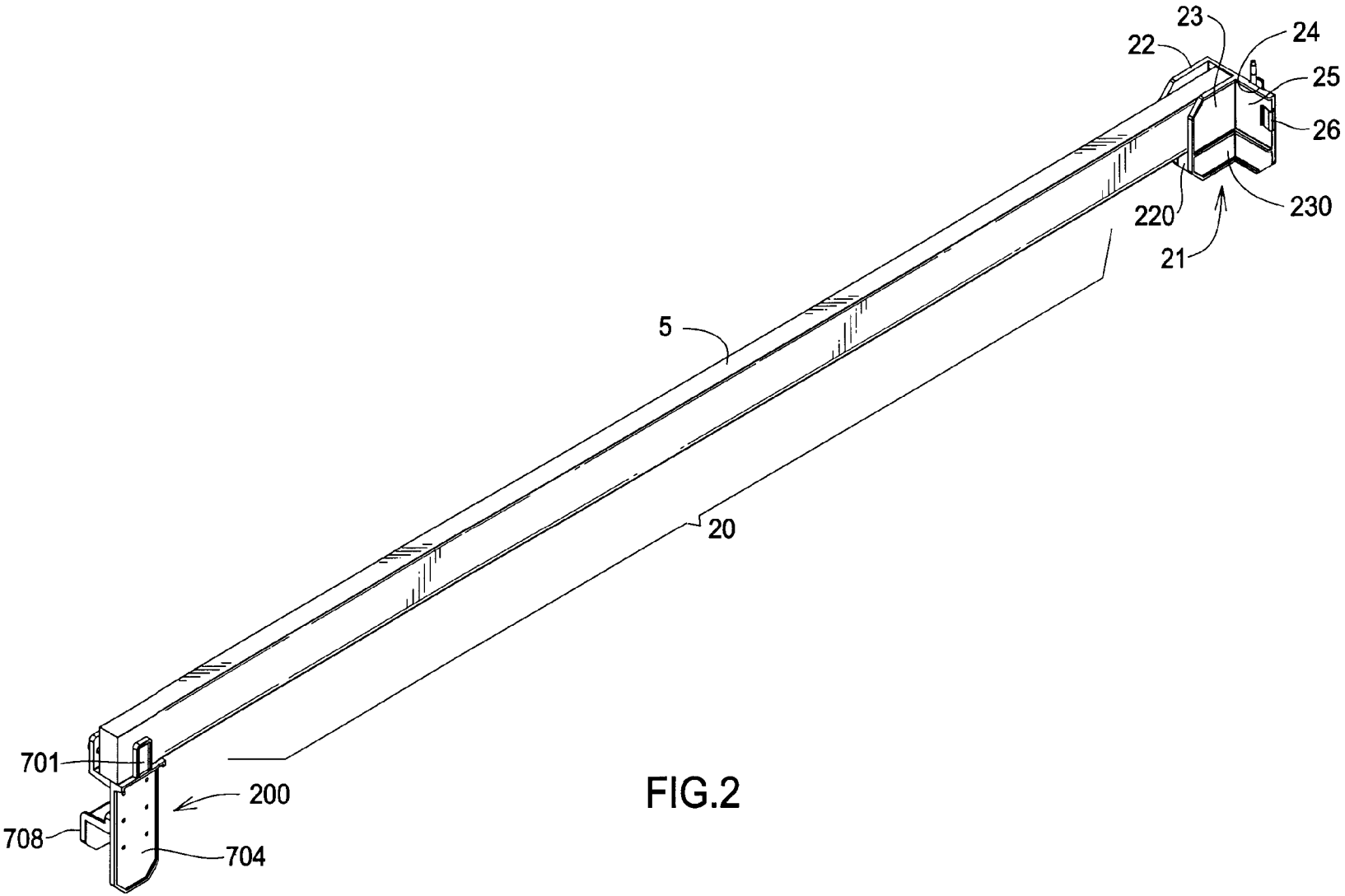
FIG. 2 is a top perspective view of the preferred embodiment kit attached to a beam.

Referring next to FIG. 2 a guide kit is designated 20, 21. Picket stand 21 consists of a pair of vertical walls 22, 23, spaced apart enough to straddle a narrow side of the 2×4 beam 5. The lower extensions 220, 230 of walls 22, 23 can receive a top 100 of a picket 1, see FIG. 5.

Adjoining the parallel walls 22, 23 is a back 24 which is perpendicular to each wall 22, 23. Back 24 has an extension panel 240 (with optional lower panel 241) which includes a writing surface 25 with a clip 26. Utensils 27 are supported by clips 28, 29 shown in FIG. 6.

Rail 5 is shown mounted with its narrow edge up, which is customary. If a builder mounted rail 5 as shown in FIG. 1 with its wide edge up, then the gap G would be wider as shown in FIG. 1.

Figure 3:
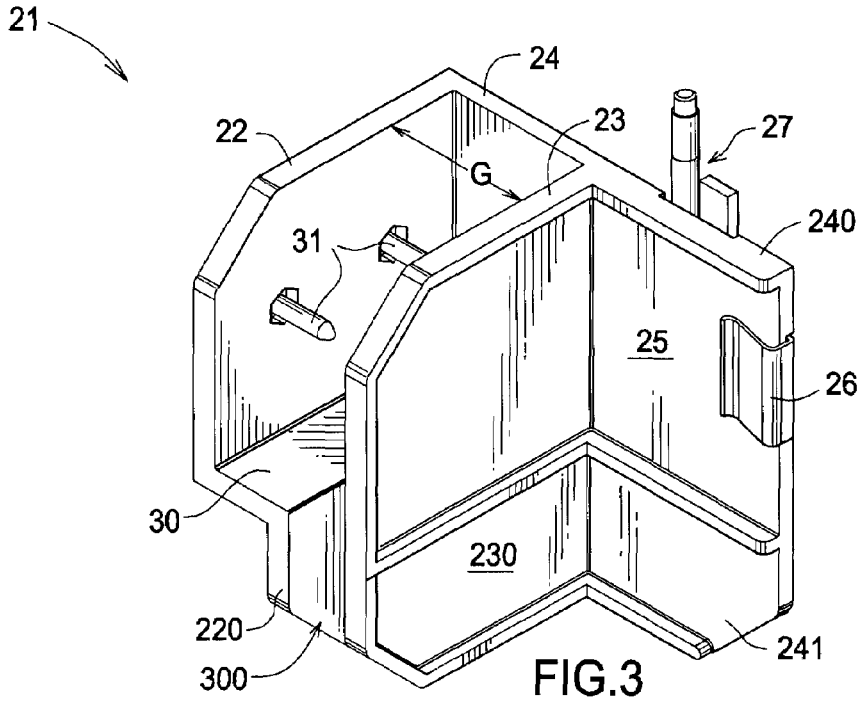
FIG. 3 is a side perspective view of the picket stand.
Figure 4:
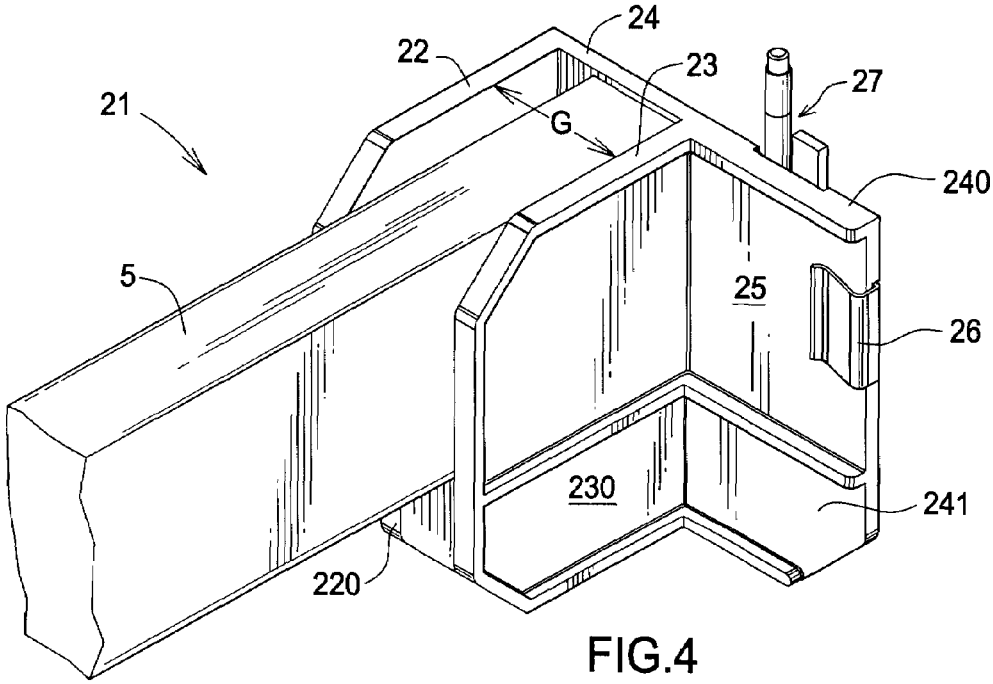
FIG. 4 is the same view as FIG. 3 with a beam attached to the picket stand.

Referring next to FIGS. 3, 4 the wall 22 is placed further from wall 23 than two inches, thus providing a ledge 30 to support beam 5 before the screws 31 are tightened to lock beam 5 against wall 23. Thus, a variety of beam 5 widths can be accommodated.

Figure 5:
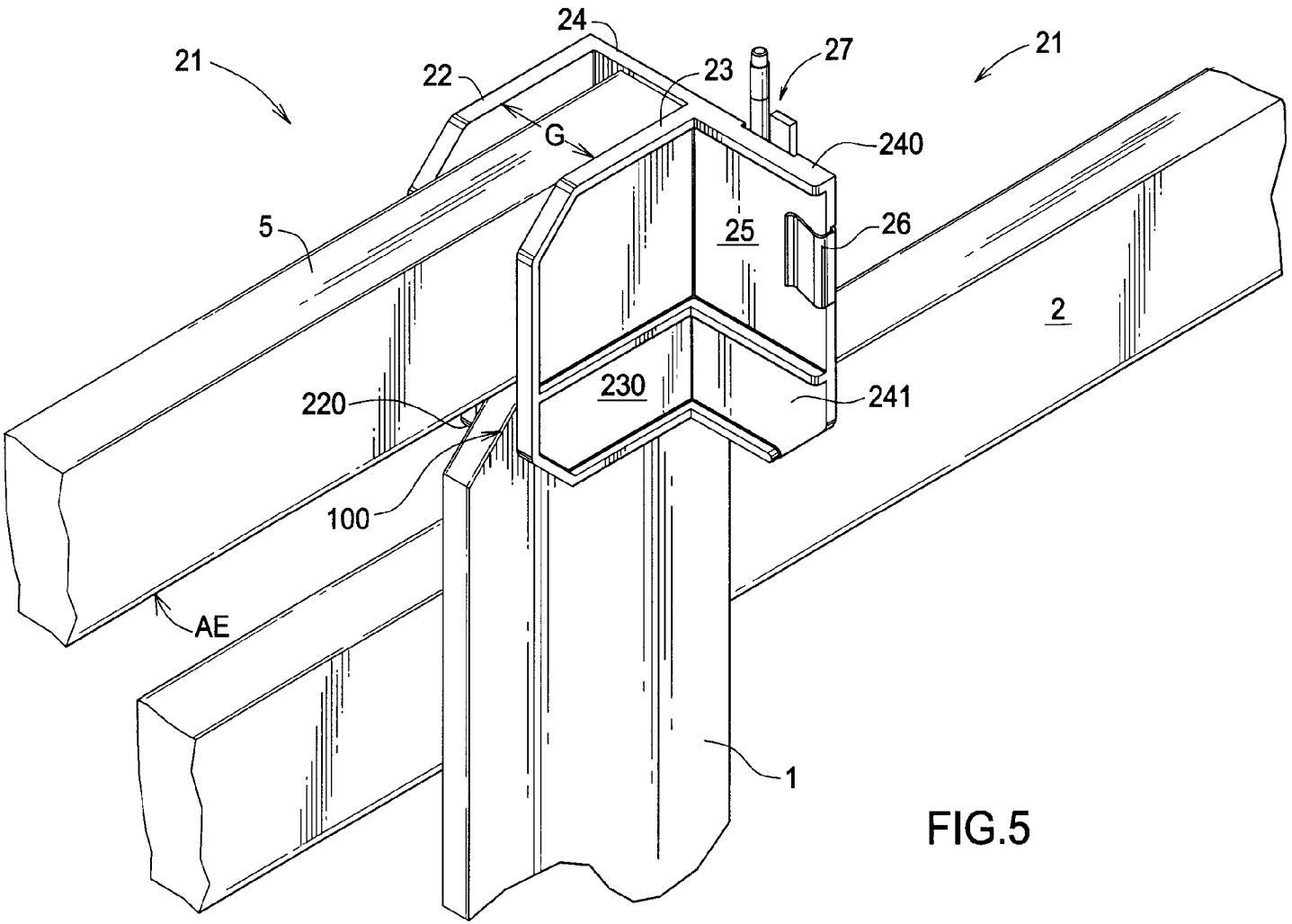
FIG. 5 is a top perspective view of the picket stand on a picket.

In FIG. 5 the picket stand 21 rests on top 100 of picket 1. Top 100 actually rests on the bottom of beam 5. Alignment edge AE is formed for subsequent picket tops.

Figure 6:
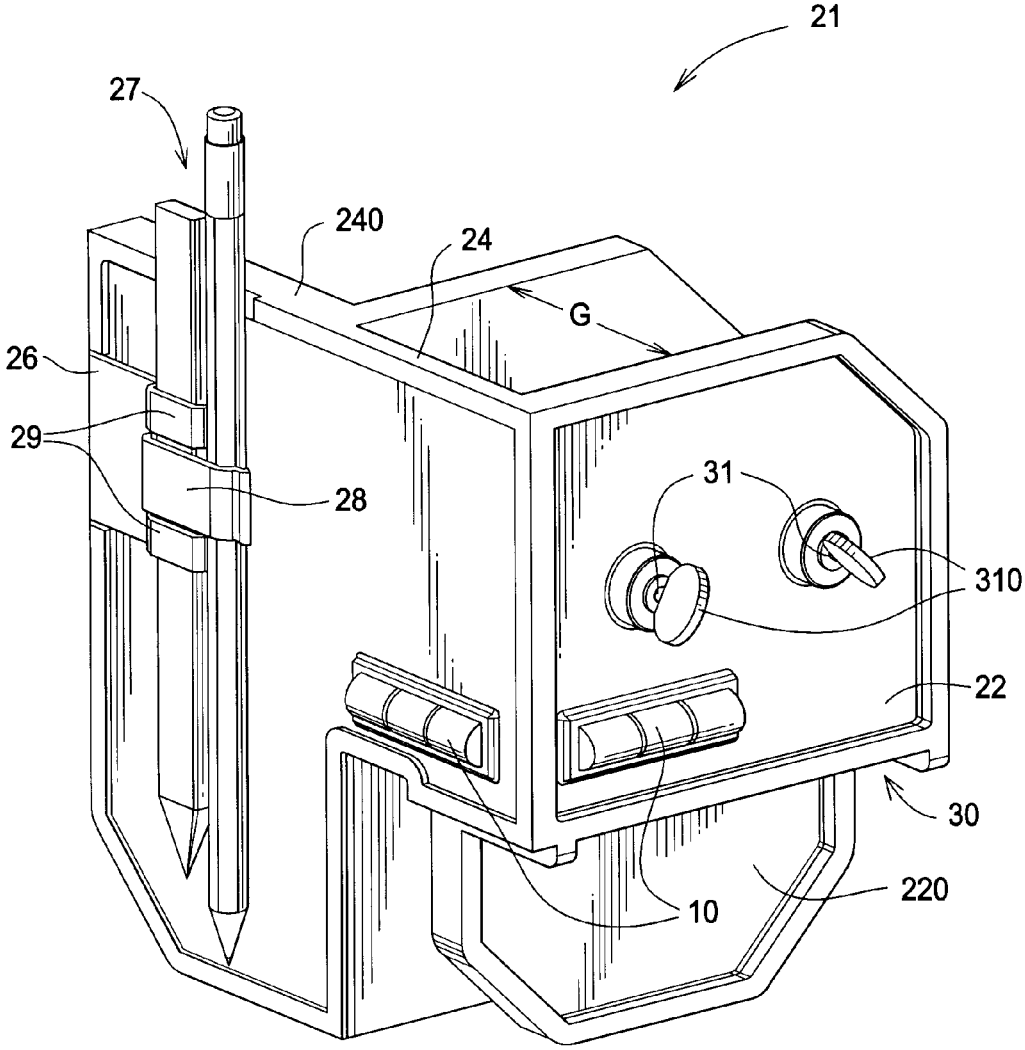
FIG. 6 is a back perspective view of the picket stand showing the two bubble levels.
Figure 8:
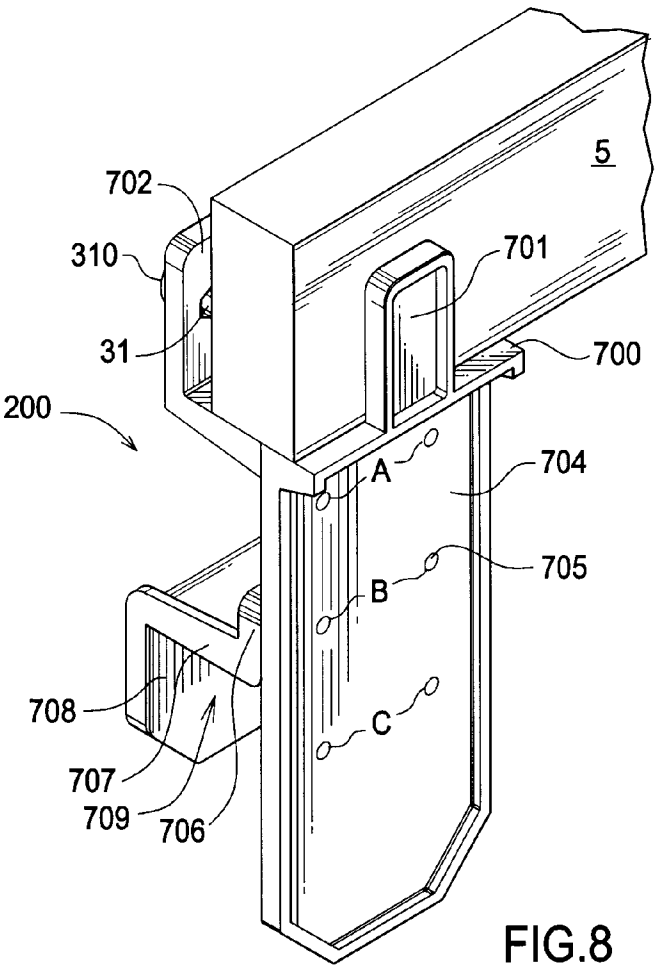
FIG. 8 is the same view as FIG. 7 with a beam attached to the beam stand.
Figure 7:
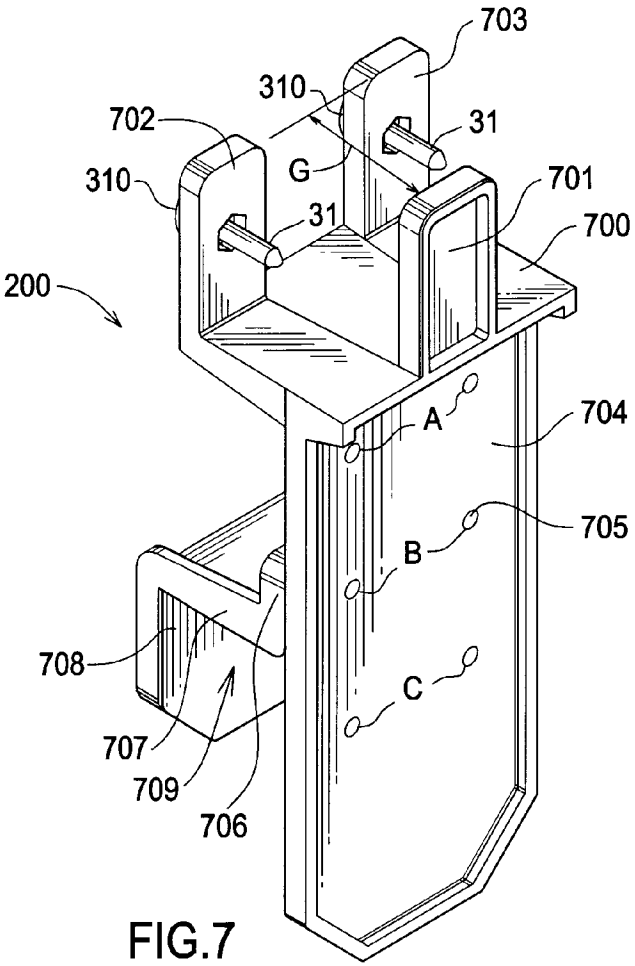
FIG. 7 is a top perspective view of a beam stand.

In FIG. 6 the screws 31 are seen to have manual turn handles 310. Preferably the picket stand 21 is molded plastic with a nut (not shown) guiding the screws 31, wherein the screws 31 are preferably threaded bolts.

Figure 10:
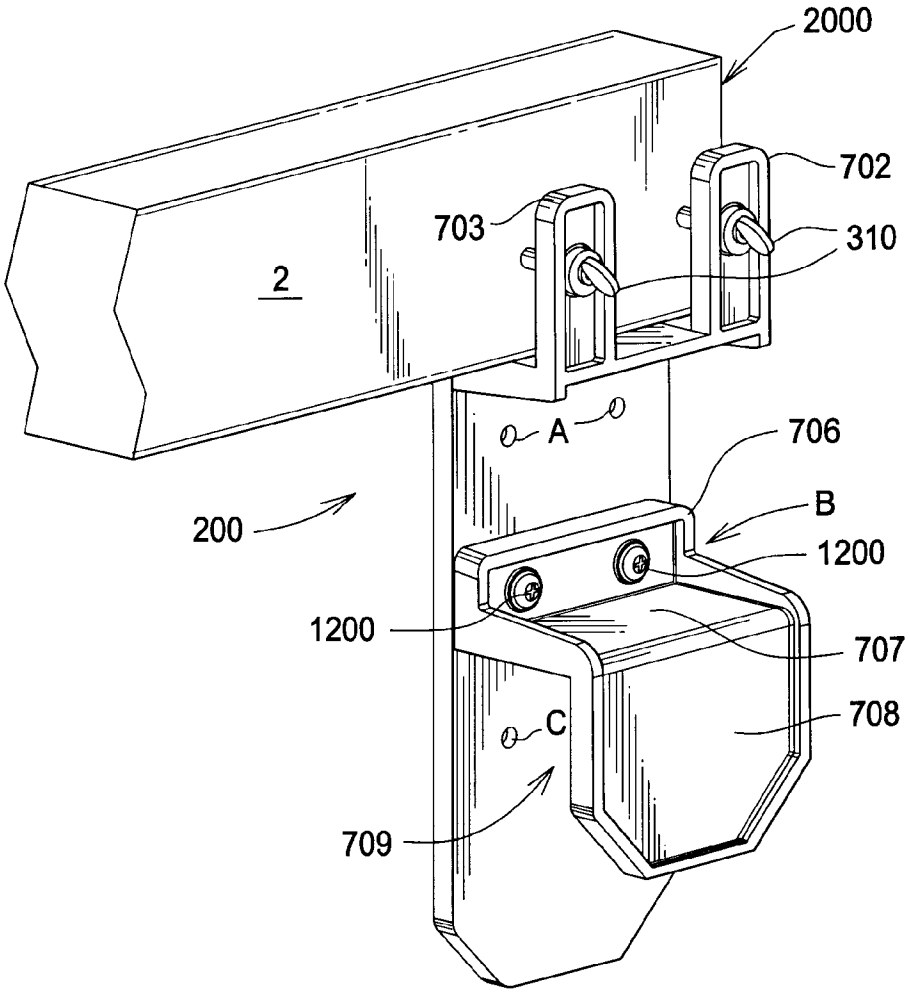
FIG. 10 is the same view as FIG. 9 with a beam attached.
Figure 9:
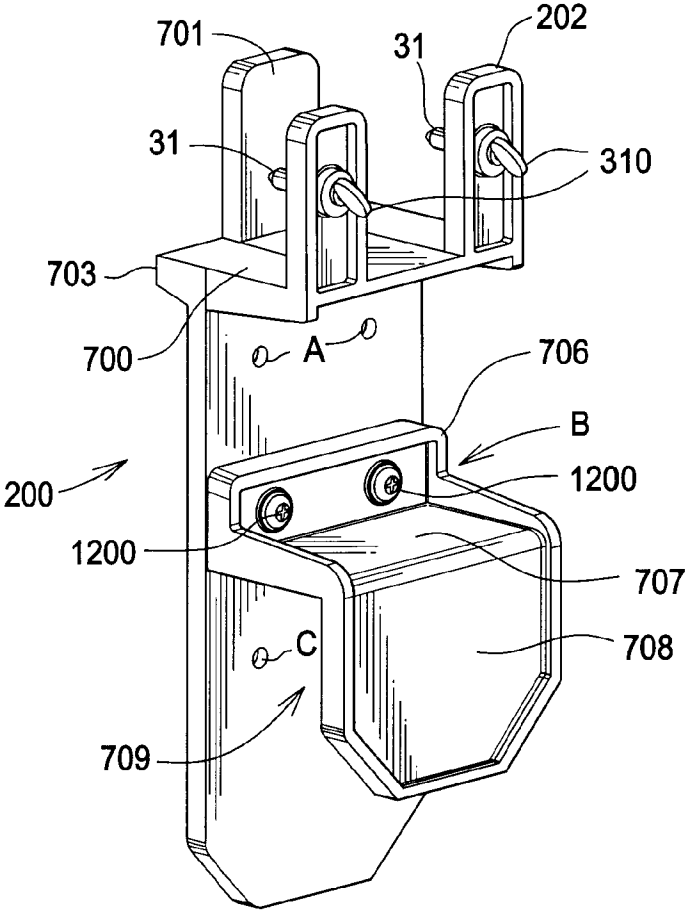
FIG. 9 is a side perspective view of the beam stand.
Figure 11:
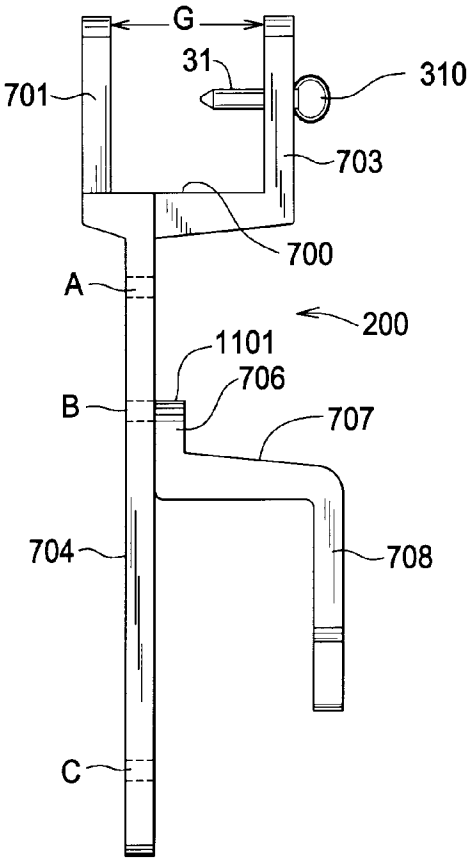
FIG. 11 is an elevational view of the beam stand.

Referring next to FIGS. 7-12 the beam stand 200 consists of a transverse alignment beam platform 700 having wall 701 oppose walls 702, 703 to receive beam 5 in gap G. Depending from platform 700 is rail guide 704 having sets of bolt guides 705 labeled A, B, C for setting bolts 1200 at a chosen height to define h, seen in FIG. 12. Mounting flange 706 supports ledge 707 (also known as saddle assembly) which in turn supports opposing rail guide 708 to accept a rail 2 in space 709. In FIG. 10 it can be seen that the end 2000 of beam 2 aligns with an outer edge of wall segment 702. FIG. 11 shows bolt hole 1101.

Figure 12:
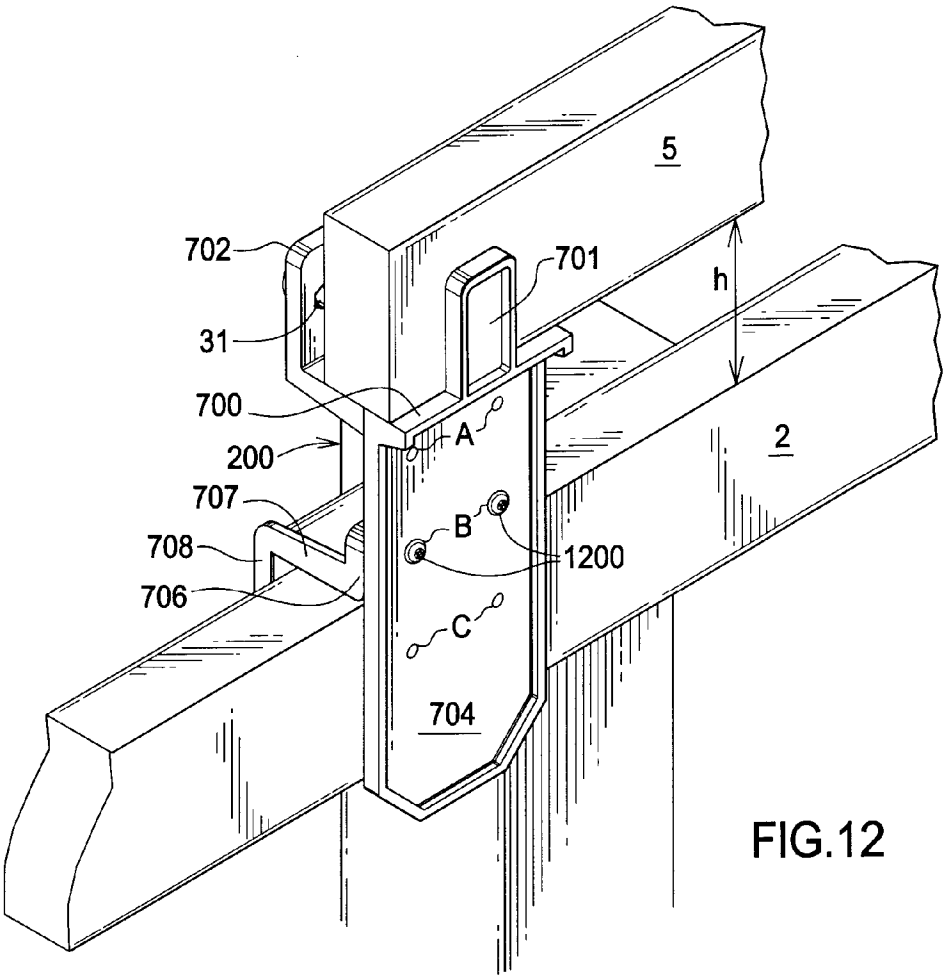
FIG. 12 is a top perspective view of the beam stand on a beam.

FIG. 12 shows post POST supporting top rail 2 of the fence before pickets are placed.

Below follows a fence building method. In all Figures, the ground is labeled D.

Figure 13:
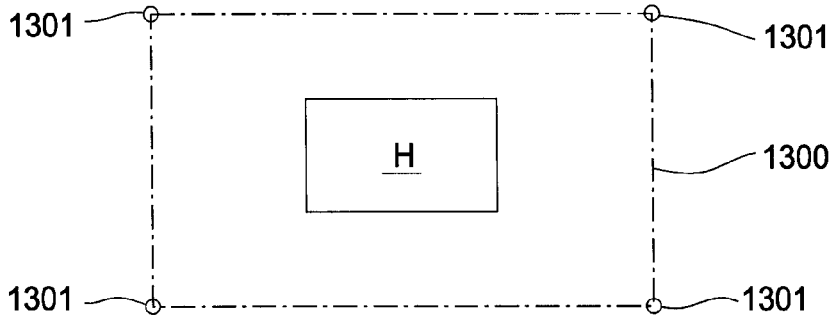
FIG. 13 is a layout of a fence around a house.
Figure 14:
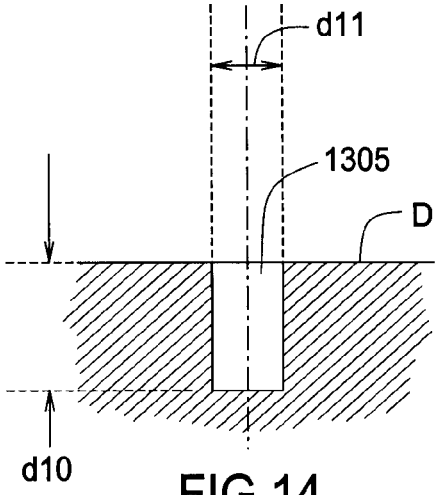
FIG. 14 is a diagrammatic view of a fence post in a hole.
Figure 15:
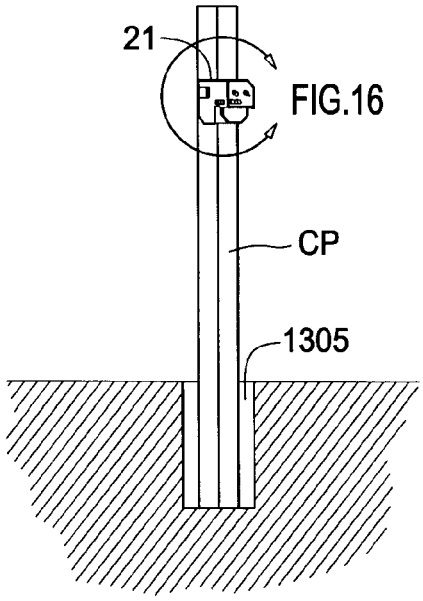
FIG. 15 is a diagrammatic view of a fence post with the post leveler.
Figure 16:
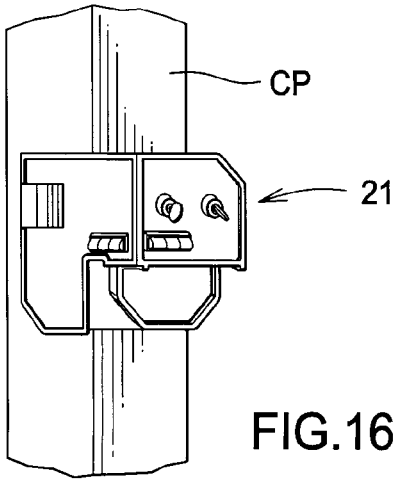
FIG. 16 is a close up view of the post leveler of FIG. 15.
Figure 17:
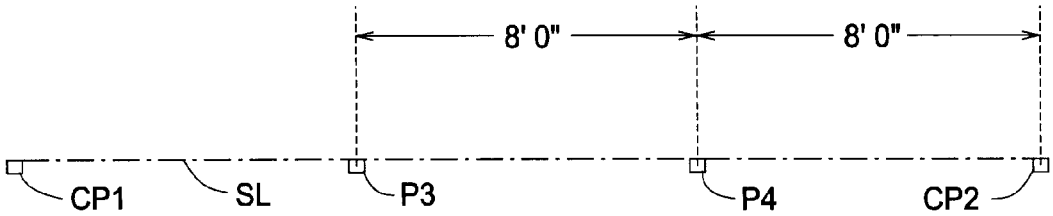
FIG. 17 is a layout of posts.
Figure 18:
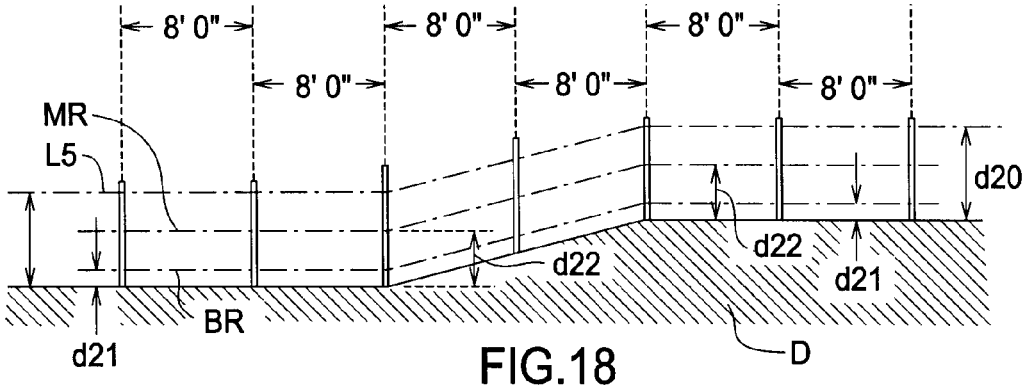
FIG. 18 is a diagrammatic view of a post layout.
Figure 19:
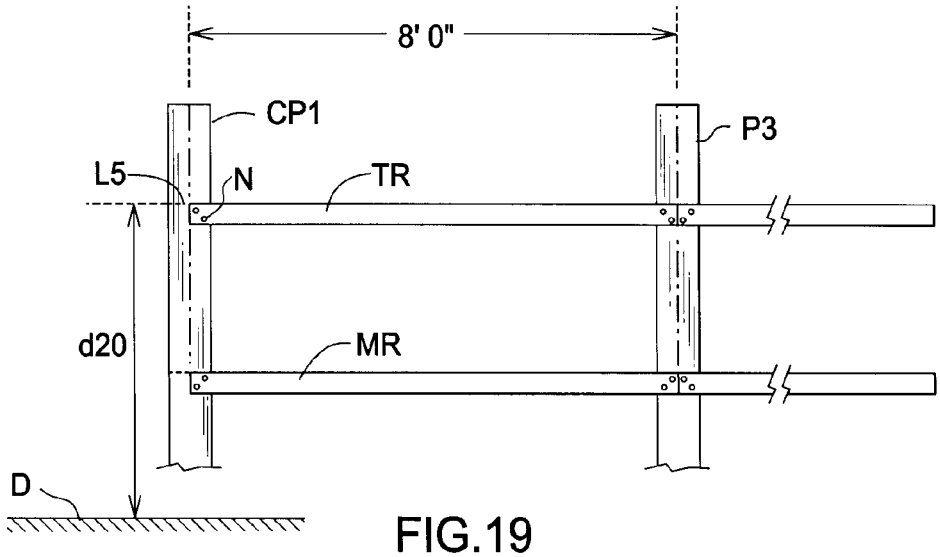
FIG. 19 is a diagrammatic view of posts and rails.
Figure 20:
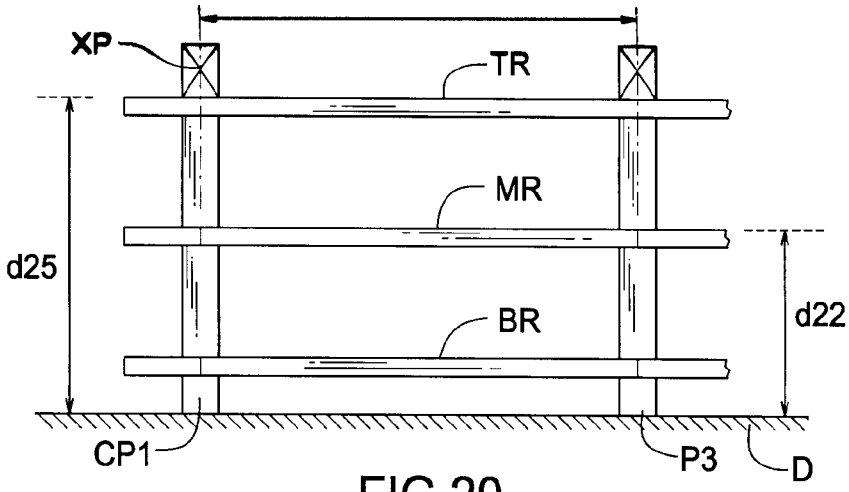
FIG. 20 is a diagrammatic view of posts and rails.
Figure 21:
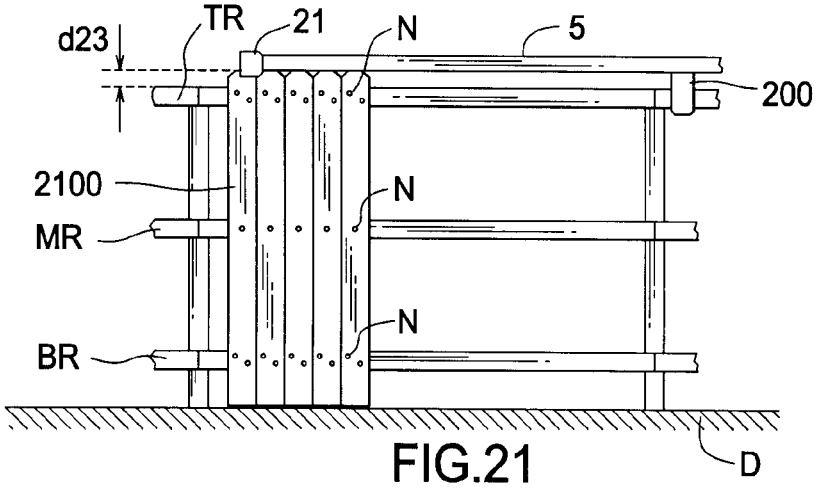
FIG. 21 is an elevational view of a picket fence in progress.
Figure 22:
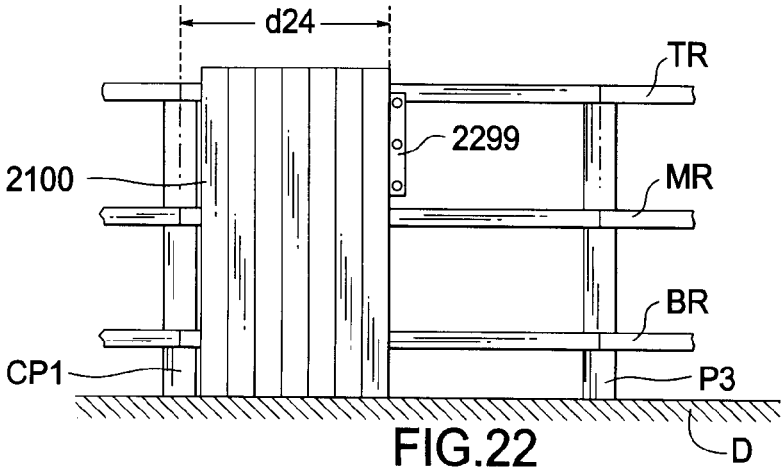
FIG. 22 is an elevational view of a picket fence in progress.

1. First determine the boundaries of your property. Find the property pins located at the intersection of each adjacent lot line, check your plot plan, usually provided by your builder at closing. A rectangular lot or square lot 1300 for house H has four property pins 1301; irregular lots will have a minimum of 5 property pins (see FIG. 13).
2. Now dig a post hole 1305 at each lot pin 1301 location. The post holes should be dug to a depth of d10=18", and the diameter d11 of the hole should be at least 10" (see FIG. 14).
3. Set your corner posts CP by placing a post CP into the post hole 1305 dug in step 2. Using your post level, item 10 FIG. 6, make sure the post is level on both sides before you pour any concrete in the hole. The concrete should be mixed fairly thick to allow your post to stay upright and level when you release the post (see FIGS. 15, 16).
4. After the concrete on your corner posts has set up, approximately 24 hours, select one corner post CP1 as your starting point and run your 100' string line SL from that corner post to the next corner post CP2. Use the straight line created by the string as a guide, dig any additional post holes you need (P3, P4) on 8 foot centers between these two corner posts. Repeat between every two corner posts until all additional post holes needed have been dug (FIG. 17). Note: For a stronger fence or if you live in a high wind area, you can set the post spacing to 5 foot centers.
5. For all additional posts, place your post into the post holes dug in step 4. Using your post level, item 10, FIG. 6, make sure that your post is level on both sides of your post before you pour your concrete in the hole. The concrete should be mixed fairly thick to allow your post to stay upright and level when you release the post. Make sure you keep your posts in line with the string you stretched between corner posts (see FIG. 17).
6. Allow approximately 24 hours for the post concrete to cure. It's time to set the fence rails between your posts. You will need to string a line L5 at d20=5'-10" high from ground level between each post. Next set the bottom rail BR at d21=12" from ground level, Ground. For the middle rail MR, split the difference between the top rail and bottom rail (see FIG. 18), D22=3'5". The grade can change so be sure you look for this.
7. Secure each rail to the fence post by install (2) 3" nails N at each end of your 2"×4"-8 foot cedar rail; make sure the top edge of the rail TR follows your straight string line (see FIG. 19).
8. Once your rails have been installed, it's time to cut off the excess post material XP that extends above the top rail. Make sure that your cut is level with the edge of the top rail TR (see FIG. 20).
9. It's time to use your "Perfect Picket Pro"™-Guide Kit, 20. Just assemble a straight 2"×4"-8 foot board 5, with no blemishes and the beam stand 200 and the picket stand 21. Set your first picket 2100 4" from the top rail d23=4" with (2) 2" nails in the top and bottom rail, and (1) 2" nail in the middle rail. Slide the picket stand 21 to the right every 4 to 5 fence pickets. Note: the stand 21 is preset for a 4" picket height above the top rail. The height can be adjusted to 2 inches or 6 inches if desired.
10. Check the pickets you are installing every 4 feet, d24=4', to make sure the side edge of the pickets remain level (see FIG. 22) using a level 2299.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A fence guide assembly for construction of a picket fence, said picket fence comprising a vertical post, a horizontal rail and a vertical picket fastened to the horizontal rail, said picket having a top projecting a desired height above the horizontal rail, the fence guide assembly comprising:

a picket stand having a pair of parallel vertical walls attached via a vertical base;

said pair of parallel vertical walls and vertical base forming a pocket with a lower ledge to receive a first end of an alignment beam;

a first member of said pair of parallel vertical walls having a fastener to secure the alignment beam;

said alignment beam forming a guide for the vertical picket which is fastened to the horizontal rail;

a first level attached to a member of the pair of parallel vertical walls;

said pair of parallel vertical walls each having a lower extension to secure the vertical picket therebetween;

a beam stand having a transverse alignment beam platform to receive a second end of the alignment beam;

said platform having a pair of opposing walls spaced apart to receive the alignment beam;

a fastener connected to one member of the platform pair of opposing walls to secure the alignment beam;

a rail guide depending from the platform;

said rail guide having a plurality of securing means functioning to fasten a saddle assembly at a desired height above the horizontal rail as the saddle assembly rests atop the horizontal rail; and wherein the saddle assembly further comprises a support ledge attached to a mounting flange for the rail guide, said support ledge having a vertical rail guide depending therefrom opposite the mounting flange.

2. The assembly of claim 1, wherein the vertical base of the picket stand has a second level attached thereto.

3. A fence guide assembly for construction of a picket fence, said picket fence comprising a vertical post, a horizontal rail and a vertical picket fastened to the horizontal rail, said picket having a top projecting a desired height above the horizontal rail, the fence guide assembly comprising:

a picket stand having a pair of parallel vertical walls attached via a vertical base;

said pair of parallel vertical walls and vertical base forming a pocket with a lower ledge to receive a first end of an alignment beam;

a first member of said pair of parallel vertical walls having a fastener to secure the alignment beam;

said alignment beam forming a guide for the vertical picket which is fastened to the horizontal rail;

a first level attached to a member of the pair of parallel vertical walls;

said pair of parallel vertical walls each having a lower extension to secure the vertical picket therebetween;

a beam stand having a transverse alignment beam platform to receive a second end of the alignment beam;

said platform having a pair of opposing walls spaced apart to receive the alignment beam;

a fastener connected to one member of the platform pair of opposing walls to secure the alignment beam;

a rail guide depending from the platform;

said rail guide having a plurality of securing means functioning to fasten a saddle assembly at a desired height above the horizontal rail as the saddle assembly rests atop the horizontal rail; and wherein the back of the picket stand further comprises an extension panel including a writing surface with a clip.

4. The assembly of claim 3, wherein the clip further comprises a pencil holding element.

5. The assembly of claim 1 wherein the securing means further comprises a plurality of holes in the rail guide and bolts therethrough which fasten the mounting flange to the rail guide.

6. A picket fence guide kit comprising:

a picket stand having a pair of parallel vertical walls spaced apart to receive an alignment beam;

said picket stand having a ledge for the alignment beam between the vertical walls, and having a slot adjacent the ledge to receive a picket attached to a horizontal rail of a fence;

said picket stand further comprising a back between said vertical walls to rest against a first end of the alignment beam;

said picket stand further comprising a securing bolt on a member of the pair of parallel, vertical walls to secure the alignment beam between the pair of parallel, vertical walls;

said picket stand having a level;

said alignment beam having a second end;

a beam stand affixable to the second end of the alignment beam;

said beam stand having a vertical rail guide with a plurality of holes arranged vertically;

a saddle sized to receive the horizontal rail of the fence is connected via bolts to a selected hole on the vertical rail guide;

said beam stand having a beam platform at an upper end of the vertical rail guide;

said beam having a pair of opposing parallel, vertical platform walls;

wherein a bolt in a member of the pair of platform walls securably fastens the second end of the alignment beam between the pair of platform walls; and wherein the saddle assembly further comprises a support ledge attached to a mounting flange for the rail guide, said support ledge having a vertical rail guide depending therefrom opposite the mounting flange.

* * * * *